US006852921B1

(12) United States Patent
Koike et al.

(10) Patent No.: US 6,852,921 B1
(45) Date of Patent: Feb. 8, 2005

(54) WIRE-PROTECTIVE TUBE

(75) Inventors: Masato Koike, Susono (JP); Atsushi Sugiyama, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/703,423

(22) Filed: Nov. 10, 2003

(51) Int. Cl.[7] ..... H01B 7/34

(52) U.S. Cl. ..... 174/36; 174/110 R; 525/88; 525/86

(58) Field of Search ..... 174/36, 110 R, 174/100 PM, 11 R; 525/86, 88, 93, 133, 155, 166, 179, 193, 222, 227, 239, 240

(56) References Cited

U.S. PATENT DOCUMENTS 4,843,129 A * 6/1989 Spenadel et al. ..... 525/240
5,081,179 A * 1/1992 Sezaki et al. ..... 524/526
5,177,147 A * 1/1993 Spenadel et al. ..... 525/88
5,569,681 A * 10/1996 Tokoro et al. ..... 521/88
5,902,764 A * 5/1999 Costa et al. ..... 502/103
6,001,933 A * 12/1999 Tsuruoka et al. ..... 525/232
6,136,743 A * 10/2000 Sugimura et al. ..... 502/113
6,374,023 B1 * 4/2002 Parris ..... 385/109
6,414,059 B1 * 7/2002 Kobayashi et al. ..... 524/101
6,562,907 B2 * 5/2003 Johoji et al. ..... 525/191
2003/0008980 A1 * 1/2003 Mawson et al. ..... 526/61
2004/0039128 A1 * 2/2004 Sasagawa et al. ..... 525/331.9

FOREIGN PATENT DOCUMENTS

JP 2000-290439 A 10/2000

* cited by examiner

*Primary Examiner*—William H. Mayo, III
(74) *Attorney, Agent, or Firm*—Sughrue Mion, PLLC

(57) ABSTRACT

A wire-protective tube which has a resin composition having 100 parts by weight of a polypropylene, from 10 to 500 parts by weight of a propylene block copolymer having a propylene monomer unit and an ethylene monomer unit in a specific proportion, from 1 to 50 parts by weight of a bromine-based flame retardant, and from 1 to 30 parts by weight of a flame retardant aid.

5 Claims, 1 Drawing Sheet

WIRE-PROTECTIVE TUBE

FIELD OF THE INVENTION

The present invention relates to a wire-protective tube which combines a high degree of heat resistance and flame retardancy with nonblooming properties and is for use especially for automotive wire harnesses.

BACKGROUND ART

Wire-protective tubes for automotive wire harnesses serve to bind coated electric wires and to protect the wires against the impact, friction, and abrasion caused by contacts with other automotive parts. These tubes have hitherto been molded mainly from non rigid vinyl chloride polymer (hereinafter referred to also as PVC). However, halogen-free materials are coming to be employed in place of poly(vinyl chloride) for producing automotive wire harness parts, e.g., tubes, so as to cope with recent measures for the preservation of global environment. Such halogen-free materials heretofore in use are compositions which comprise an olefin elastomer, e.g., a propylene/(ethylene/propylene) copolymer, and a metal hydroxide added thereto as a flame retardant so as to give importance to heat resistance and abrasion resistance.

On the other hand, wire-protective tubes for automotive wire harnesses are recently coming to be increasingly required to have higher flame retardancy. However, it is becoming impossible, with the compositions comprising an olefin elastomer and a metal hydroxide, to attain the flame retardancy required. Furthermore, it is advocated as a part of measures for environmental preservation to reduce fuel consumption by reducing the weights of motor vehicles. For attaining this, weight reduction in parts including wire harnesses also is important. However, poly (vinyl chloride) and the compositions comprising an olefin elastomer and a metal hydroxide have a specific gravity of 1.3 or higher and this is an obstacle to weight reduction.

An olefin elastomer composition comprising an olefin elastomer, e.g., a propylene/(propylene/ethylene) copolymer, and a bromine compound flame retardant incorporated therein is reported in JP-A-2000-290439 for the purpose of attaining a high degree of flame retardancy and weight reduction.

The wire harnesses disposed in automotive engine rooms are always exposed to high temperatures, and there are cases where the ambient temperature exceeds 150° C. However, use of wire-protective tubes made of those olefin elastomer compositions in this application poses a serious problem that the wire-protective tubes, in which the olefin elastomer is the only resin ingredient, soften to become unable to retain their shape, i.e., are deprived of their function as a protective material. In the case of the olefin elastomer composition containing a propylene/(propylene/ethylene) copolymer as the only resin ingredient, there are problems that appearance failures are apt to occur due to melt fracture during tube molding, that insertion of coated wires into the tube is difficult, and that wire tips may mar the inner surface of the tube. In addition, among olefin elastomers, ethylene/propylene copolymers, for example, have a serious problem that, as compared with propylene/(propylene/ethylene) copolymers, impartation of flame retardancy thereto is difficult in olefin elastomer compositions containing a bromine compound flame retardant and a high degree of flame retardancy cannot be imparted especially in tubes, which are thin-wall moldings.

With the desire for improvements in flame retardancy, a problem has arisen that the flame retardants incorporated cause appearance failures through blooming, etc. For example, tetrabromobisphenol A bis(2,3-dibromopropyl) ether is known as a flame retardant which imparts high flame retardancy to polyolefins. However, impartation of a flame retardancy of oxygen concentration index 24, which is required of wire-protective tubes, with this bisphenol A derivative results in enhanced blooming, although satisfactory heat resistance is obtained. Tetrabromobisphenol S bis (2,3-dibromopropyl) ether is known as a flame retardant which also imparts high flame retardancy to polyolefins and which is reduced in blooming. However, when used with a polymeric material having a high melt viscosity, this flame retardant decomposes during extrusion molding to cause a molding failure, i.e., burn marks. Tris(2,3-dibromopropyl) isocyanurate also is known as a flame retardant which imparts high flame retardancy to polyolefins. However, when this flame retardant is used in such an amount as to impart a flame retardancy of oxygen concentration index 24, part of the flame retardant adheres to the sizing die and roll and then readheres to the surface of the wire-protective tube to cause an appearance failure.

SUMMARY OF THE INVENTION

An object of the invention is to provide a wire-protective tube which is excellent in abrasion resistance and heat resistance, has sufficiently high flame retardancy, is lightweight, is equal in flexibility to non rigid vinyl chloride polymer to facilitate wire insertion thereinto, is free from appearance failure, e.g., blooming, and is especially suitable for application to automotive wire harnesses.

The present inventors made intensive investigations in order to overcome the problems described above. As a result, they have found that all those problems can be eliminated by using, as a wire-protective tube molding material, a resin composition obtained by incorporating a bromine-based flame retardant and a flame retardant aid into a resin ingredient obtained by mixing a polypropylene with a propylene block copolymer comprising propylene monomer units and ethylene monomer units in a specific proportion. The invention has been completed based on this finding.

That is, the invention provides a wire-protective tube as follows in order to accomplish the aforementioned object.

(1) A wire-protective tube which comprises a resin composition comprising:

polypropylene; and (a) from 10 to 500 parts by weight of a propylene block copolymer comprising a high-temperature component eluted at 100° C. or higher and a low-temperature component eluted at lower than 100° C. according to the temperature-rising elution fractionation method are from 1 to 40% by weight and from 99 to 60% by weight, respectively, wherein the high-temperature component is a polymer comprising from 100 to 90 mol % of a propylene monomer unit and from 0 to 10 mol % of an ethylene monomer unit, and wherein the low-temperature component is a polymer comprising from 90 to 50 mol % of a propylene monomer unit and from 10 to 50 mol % of an ethylene monomer unit;

(b) from 1 to 50 parts by weight of a bromine-based flame retardant; and (c) from 1 to 30 parts by weight of a flame retardant aid, each based on 100 parts by weight of the polypropylene.

(2) The wire-protective tube according to the above (1), wherein the bromine-based flame retardant is at least one selected from the group consisting of tetrabromobisphenol A bis(2,3-dibromopropyl) ether, tetrabromobisphenol S bis(2,3-dibromopropyl) ether, and tris(2,3-dibromopropyl) isocyanurate.

(3) The wire-protective tube according to the above (2), wherein the bromine-based flame retardant is a mixture of tetrabromobisphenol A bis(2,3-dibromopropyl) ether and tetrabromobisphenol S bis (2,3-dibromopropyl) ether or a mixture of tetrabromobisphenol A bis(2,3-dibromopropyl) ether and tris(2,3-dibromopropyl) isocyanurate.

(4) The wire-protective tube according to the above (1), which further comprises from 0 to 50 parts by weight of an ethylene/vinyl acetate copolymer based on 100 parts by weight of the resin composition.

(5) The wire-protective tube according to the above (1), which further comprises from 0 to 30 parts by weight of an inorganic filler based on 100 parts by weight of the resin composition.

Figure 1:
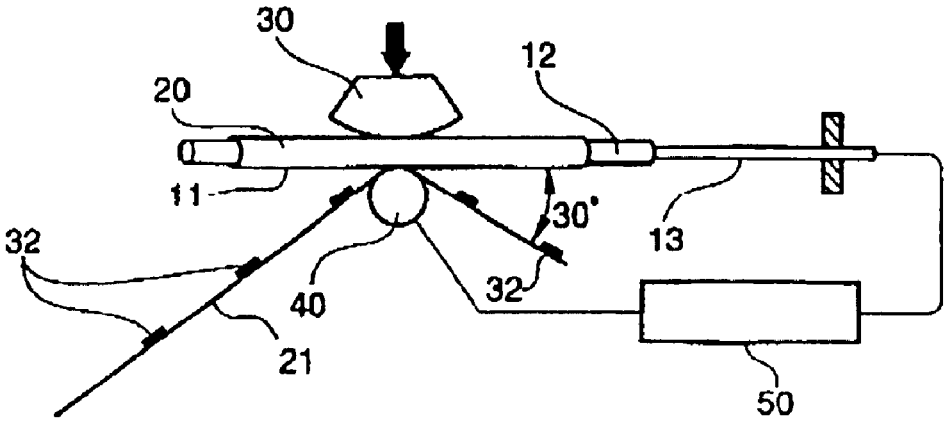
FIG. 1 is a diagrammatic view illustrating the test apparatus used in a tape abrasion test.

In Figs., sign 11 is a tube, sign 12 is a metal roll, sign 13 is an electric wire, sign 20 is a sample, sign 21 is an abrasion tape, sign 30 is a pressing member, sign 32 is a conductive area, sign 40 is a roll, sign 50 is a conduction detector, sign 101 is a pressing member, sign 103 is a plunger, sign 104 is a clamp, sign 105 is a sample holder, sign 106 is a metal rod, sign 108 is a piano wire, and sign 111 is a tube.

DETAILED DESCRIPTION OF THE INVENTION

Preferred modes for carrying out the invention will be explained below.

The wire-protective tube of the invention employs as a resin ingredient a mixture of a polypropylene and a propylene block copolymer having a specific crystal distribution.

The polypropylene to be used in the invention may be a polypropylene, a random or block copolymer of propylene and one or more α-olefins such as ethylene and butylene, or a mixture of two or more of these.

On the other hand, the propylene block copolymer has a specific crystal distribution determined by the temperature-rising elution fractionation method. This temperature-rising elution fractionation method is described in detail in, e.g., *Journal of Applied Polymer Science*; Applied Polymer Symposium 45, 1–24 (1990). In this method, a high-temperature solution of a polymer is first introduced into a column packed with diatomaceous earth as a packing, and the column temperature is gradually lowered to thereby crystallize the components of the polymer on the packing surface in order of their reducing melting point. Subsequently, the column temperature is gradually elevated to thereby elute the components in order of their increasing melting point to fractionate the polymer components eluted.

In the invention, the values concerning the crystal distribution were determined through examination with apparatus SSC-7300, manufactured by Senshu Kagaku, under the conditions of a solvent of o-dichlorobenzene, flow rate of 2.5 mL/min, heating rate of 4° C./hr, and column of ϕ30 mm×300 mm, as shown in the Examples.

The high-temperature component in the invention is the component eluted at 100° C. or higher in temperature-rising fractionation under those conditions. This component is a polymer comprising from 100 to 90 mol %, preferably from 100 to 95 mol %, a propylene monomer unit and from 0 to 10 mol %, preferably from 0 to 5 mol %, an ethylene monomer unit.

When the proportion of an ethylene monomer unit exceeds 10 mol %, this block copolymer is undesirable because it gives a resin composition having reduced heat resistance.

As long as the proportion requirement is satisfied, the high-temperature component may be either a polypropylene, a propylene/ethylene copolymer, or a mixture of a polypropylene and a propylene/ethylene copolymer.

The low-temperature component in the invention is the component eluted at lower than 100° C. in temperature-rising fractionation under the conditions shown above. This component is a polymer comprising from 90 to 50 mol %, preferably from 85 to 45 mol %, of a propylene monomer unit and from 10 to 50 mol %, preferably from 15 to 45 mol %, of an ethylene monomer unit.

When the proportion of a propylene monomer unit exceeds 90 mol % and the proportion of an ethylene monomer unit is less than 10 mol %, this block copolymer is undesirable because it gives a resin composition having insufficient flexibility.

On the other hand, when the proportion of a propylene monomer unit is less than 50 mol % and the proportion of an ethylene monomer unit exceeds 50 mol %, this block copolymer is undesirable because it gives a resin composition insufficient in heat resistance and flame retardancy.

As long as the proportion requirement shown above is satisfied, the low-temperature component may be either a propylene/ethylene copolymer or a mixture of a polypropylene and a propylene/ethylene copolymer.

In the propylene block copolymer, the proportions of the high-temperature component and the low-temperature component are from 1 to 40% by weight and from 99 to 60% by weight, respectively. When the proportion of the high-temperature component is less than 1% by weight and that of the low-temperature component exceeds 99% by weight, particles of this propylene block copolymer obtained are apt to stick to one another, making the production difficult. Furthermore, such a block copolymer is undesirable because the wire-protective tube molded from a composition containing this block copolymer has insufficient heat resistance.

On the other hand, when the proportion of the high-temperature component exceeds 40% by weight and that of the low-temperature component is less than 60% by weight, this block copolymer gives a resin composition reduced in flexibility and heat resistance. Namely, the desired resin composition cannot be obtained. When flexibility, heat resistance, and mechanical and other properties are taken into account, it is preferred that the proportion of the high-temperature component be in the range of from 3 to 40% by weight, especially from 5 to 35% by weight, and that of the low-temperature component be in the range of from 97 to 60% by weight, especially from 95 to 65% by weight.

From the standpoint of obtaining satisfactory heat resistance and flexibility, the propylene block copolymer preferably is one which is a molecular-level mixture of: molecular chains of a so-called block copolymer in which a polypropylene segment and a propylene/ethylene random copolymer segment are arranged in each molecular chain; and molecular chains comprising molecular chains consisting of polypropylene alone and molecular chains consisting of a propylene/ethylene random copolymer alone.

In the propylene block copolymer, the polypropylene segments or molecules and/or the propylene/ethylene random copolymer segments or molecules may contain one or more other α-olefins copolymerized therewith in an amount of, e.g., up to 5% by mole, as long as the α-olefins incorporated do not impair the properties of the propylene resin composition. Furthermore, commercial additives such as, e.g., antioxidants, heat stabilizers, and chlorine scavengers may be added to the propylene block copolymer. In this case, the copolymer may be pelletized with an extruder after mixing with such additives.

An organic peroxide may be added, besides those additives, to regulate the molecular weight of the propylene block copolymer to a value within a range suitable for satisfying the requirements in the invention. Known organic peroxides can be used without any particular limitations. Typical examples thereof include ketone peroxides such as methyl ethyl ketone peroxide, methyl isobutyl ketone peroxide, and cyclohexane peroxide; diacyl peroxides such as isobutyryl peroxide, lauroyl peroxide, and benzoyl peroxide; hydroperoxides such as diisopropylbenzene hydroperoxide; dialkyl peroxides such as dicumyl peroxide, 2,5-dimethyl-2,5-di(t-butylperoxy)hexane, 1,3-bis (t-butylperoxyisopropyl)benzene, di-t-butyl peroxide, and 2,5-dimethyl-2,5-di (t-butylperoxy) hexane-3; peroxyketals such as 1,1-di-t-butylperoxy-3,3,5-trimethylcyclohexane and 2,2-di(t-butylperoxy)butane; alkyl peresters such as t-butyl peroxypivalate and t-butyl peroxybenzoate; and percarbonates such as t-butyl peroxyisopropylcarbonate.

The flowability of the propylene block copolymer in a molten state is not particularly limited. However, from the standpoint of moldability, the melt flow rate (hereinafter often abbreviated as MFR) thereof is in the range of preferably from 0.1 to 100 g/10 min, more preferably from 0.5 to 60 g/10 min. This melt flow rate herein is measured by the method in accordance with JIS K7210.

The proportion of the propylene block copolymer should be from 10 to 500 parts by weight based on 100 parts by weight of the polypropylene. Proportions thereof smaller than the lower limit are undesirable because the resin composition obtained has insufficient flexibility. Proportions thereof exceeding the upper limit are undesirable because not only the resin composition has reduced abrasion resistance but also it is difficult to attain shape retention at ambient temperatures exceeding 150° C., which is one of the properties to be attained by the invention.

A bromine-based flame retardant and a flame retardant aid are incorporated into the resin ingredient described above.

The kind of the bromine-based flame retardant is not particularly limited, and bromine-based flame retardants heretofore in use as flame retardants for resins, rubbers, and the like are usable. Preferred of these are tetrabromobisphenol A bis(2,3-dibromopropyl) ether, tetrabromobisphenol S bis(2,3-dibromopropyl) ether, and tris(2,3-dibromopropyl) isocyanurate. However, these flame retardants have their respective drawbacks as stated above. Consequently, when incorporation of a large amount of a flame retardant is necessary so as to impart an oxygen concentration index of 24, which is required of wire-protective tubes, then it is preferred to use two flame retardants in combination.

Preferred in this case are a combination of tetrabromobisphenol A bis(2,3-dibromopropyl) ether and tetrabromobisphenol S bis(2,3-dibromopropyl) ether and a combination of tetrabromobisphenol A bis(2,3-dibromopropyl) ether and tris(2,3-dibromopropyl) isocyanurate. In each combination, the proportion of the former to the latter is preferably from 9:1 to 4:6 by weight. Too large proportions of tetrabromobisphenol A bis (2,3-dibromopropyl) ether in each combination are undesirable because blooming is apt to occur. Too large proportions of tetrabromobisphenol S bis(2,3-dibromopropyl) ether in the former combination are undesirable because burn marks are apt to generate. Furthermore, too large proportions of tris(2,3-dibromopropyl) isocyanurate in the latter combination are undesirable because appearance failures are apt to occur since part of this flame retardant tends to adhere to the sizing die and roll and then readhere to the molding surface.

The amount of the flame retardant to be incorporated should be from 1 to 50 parts by weight based on 100 parts by weight of the polypropylene, regardless of whether the flame retardant consists of a single compound or of a combination of two or more compounds. For obtaining a more stable molding appearance, the amount thereof is preferably from 1 to 40 parts by weight. Flame retardant amounts smaller than the lower limit are undesirable because sufficient flame retardancy cannot be obtained. Amounts thereof larger than the upper limit are undesirable because not only the resin composition has an increased specific gravity and gives a wire-protective tube having appearance failures due to blooming, die fouling, etc., but also a stable kneading operation is difficult to perform.

Examples of the flame retardant aid to be used in the invention include antimony compounds such as antimony trioxide and boron compounds such as zinc borate and borax. Preferred of these is antimony trioxide from the standpoint of the effects of the invention. The amount of the flame retardant aid to be incorporated should be from 1 to 30 parts by weight based on 100 parts by weight of the polypropylene. From the standpoint of securing a stable high degree of flame retardancy, the amount thereof is preferably from 1 to 25 parts by weight. Amounts of the flame retardant aid smaller than the lower limit are undesirable because sufficient flame retardancy cannot be obtained. Amounts thereof larger than the upper limit are undesirable because the resin composition has an increased specific gravity and reduced flame retardancy and a stable kneading operation is difficult to perform.

An ethylene/vinyl acetate copolymer may be further incorporated in the invention into the resin composition comprising the polypropylene, propylene block copolymer, bromine compound flame retardant, and flame retardant aid described above (hereinafter, this resin composition is referred to as "basic resin composition"). The incorporation of this copolymer is effective in significantly diminishing the blooming of the flame retardant contained, without considerably reducing flame retardancy. As the ethylene/vinyl acetate copolymer can be used any of general commercial products without particular limitations. Of these, however, ethylene/vinyl acetate copolymers having a vinyl acetate monomer unit content of from 20 to 30% by weight are preferred. Vinyl acetate monomer unit contents lower than 20% by weight are undesirable because such a copolymer should be incorporated in a large amount so as to sufficiently prevent flame retardant blooming and this large copolymer amount reduces flame retardancy and abrasion resistance. Vinyl acetate monomer unit contents higher than 30% by weight are undesirable because not only moldability and abrasion resistance are reduced but also a stable kneading operation is difficult to perform.

The amount of the ethylene/vinyl acetate copolymer to be incorporated should be not larger than 50 parts by weight based on 100 parts by weight of the basic resin composition. From the standpoint of securing a stable high degree of flame retardancy and abrasion resistance, the amount of the copolymer is preferably 40 parts by weight or less.

When the basic resin composition further comprises an inorganic filler, it gives a wire-protective tube having a fishskined inner surface. As a result, the marring of the tube inner surface by wire tips in the insertion of coated wires into the wire-protective tube is mitigated and the insertion operation can be carried out smoothly. As the inorganic filler can be used any of known inorganic fillers for polyolefin resins without particular limitations. Examples thereof include talc, mica, calcium carbonate, barium sulfate, glass fibers, and magnesium hydroxide.

The amount of the inorganic filler to be incorporated should be 30 parts by weight or less based on 100 parts by weight of the basic resin composition. From the standpoint of securing a stable high degree of flame retardancy and resistance to friction and abrasion, the amount of the inorganic filler is preferably 25 parts by weight or less.

Besides the ingredients described above, other polyolefin resins may be incorporated into the basic resin composition as long as the effects of the invention are not lessened thereby. Examples of such optional polyolefin resins include high-density polyethylene, medium-density polyethylene, low-density polyethylene, linear polyethylenes formed by the copolymerization of ethylene and a C4 to C10 hydrocarbon, ethylene/propylene copolymers (EPDM), ethylene/butene-1 copolymers, propylene/butene-1 copolymers, poly(1-butene), poly (1-pentene), poly (4-methylpentene-1), polybutadiene, and polyisoprene.

Examples of other resins which can be incorporated besides those resins include ethylene methacrylate, polychloroprene, halogenated polyethylene, halogenated polypropylene, fluororesins, acrylonitrile/butadiene rubbers, polystyrene, poly(butadiene terephthalate), polycarbonates, poly(vinyl chloride), fluororubbers, poly(ethylene terephthalate), polyamides, acrylonitrile/butadiene/styrene copolymers, petroleum hydrocarbon resins such as petroleum resins, hydrogenated petroleum resins, terpene resins, and hydrogenated terpene resins, and aromatic vinyl rubbers such as styrene/butylene/styrene block copolymers, styrene/isoprene/styrene block copolymers, styrene/ethylene/butylene/styrene block copolymers, styrene/propylene/butylene/styrene block copolymers, and hydrogenated styrene/butadiene rubbers.

It is desirable that those polyolefin and other resins as optional ingredients be incorporated in an amount of preferably 100 parts by weight or less, more preferably 50 parts by weight or less, most preferably 40 parts by weight or less, based on 100 parts by weight of the basic resin composition.

Known phenolic antioxidants can be used in the basic resin composition according to need without particular limitations. Examples thereof include 2,6-di-t-butyl-4-hydroxyphenol, 2,6-di-t-butyl-p-cresol, 2,6-diphenyl-4-octadecyloxyphenol, stearyl (3,5-di-t-butyl-4-hydroxyphenyl)propionate, distearyl (3,5-di-t-butyl-4 hydroxybenzyl)phosphonate, thiodiethylene glycol bis[(3,5-di-t-butyl-4-hydroxyphenyl)propionate], 4,4'-thiobis(6-t-butyl-m-cresol), 2-octylthio-4,6-di(3,5-di-t-butyl-4-hydroxyphenoxy)-s-triaz ine, 2,2'-methylenebis(4-methyl-6-t-butylphenol), 2,2'-methylenebis(4-ethyl-6-t-butylphenol), bis[3,3'-bis(4-hydroxy-3-t-butylphenyl) butyric acid] glycol esters, 4,4'-butylidenebis(6-t-butyl-m-cresol), 2,2'-ethylidenebis(4,6-di-t-butylphenol), 2,2'-ethylidenebis(4-t-butyl-6-t-butylphenol), 1,1,3-tris(2-methyl-4-hydroxy-5-t-butylphenyl)butane, bis[2-t-butyl-4-methyl-6-(2-hydroxy-3-t-butyl-5-methylbenzy 1)phenyl] terephthalate, 1,3,5-tris(2,6-dimethyl-3-hydroxy-4-t-butylbenzyl) isocyanate, 1,3,5-tris(3,5-di-t-butyl-4-hydroxybenzyl) isocyanate, 1,3,5-tris(3,5-di-t-butyl-4-hydroxybenzyl)-2,4,6-trimethyl benzene, 1,3,5-tris[(3,5-di-t-butyl-4-hydroxyphenyl)propionyloxyethyl ] isocyanate, tetrakis[methylene(3,5-di-t-butyl-4-hydroxyphenyl) propionate]methane, 2-t-butyl-4-methyl-6-(2-acryloyloxy-3-t-butyl-5-methylbenzyl)phenol, 3,9-bis(1,1-dimethyl-2-hydroxyethyl)-2,4,8,10-tetraoxaspiro [5.5]undecane bis[β-(3-t-butyl-4-hydroxy-5-methylphenyl)propionate], and triethylene glycol bis[β-(3-t-butyl-4-hydroxy-5-methylphenyl)propionate]. Those phenolic antioxidants may be added in an amount of generally from 0.001 to 2 parts by weight, preferably from 0.01 to 1.5 parts by weight, based on 100 parts by weight of the basic resin composition. Those phenolic antioxidants may be used alone or in combination of two or more thereof. Amounts thereof smaller than 0.001 part by weight are undesirable because the resin deteriorates considerably and hence yellows. Amounts thereof exceeding 2 parts by weight are undesirable because the antioxidant blooms considerably to impair the appearance of the wire-protective tube.

Known organophosphorus antioxidants can be used in the basic resin composition according to need without particular limitations. Examples thereof include trisnonylphenyl phosphite, tris(2,4-di-t-butylphenyl) phosphite, di(tridecyl) pentaerythritol diphosphite, bis(2,4-di-t-butylphenyl) pentaerythritol diphosphite, bis(2,6-di-t-butyl-4-methylphenyl)pentaerythritol diphosphite, tetra(tridecyl) isopropylidenediphenol diphosphite, tetra(tridecyl)-4,4-n-butylidenebis(2-t-butyl-5-methylphenol) diphosphite, hexa (tridecyl)-1,1', 3-tris(3-t-butyl-4-hydroxy-5-methylphenyl) butane triphosphite, 2,2'-methylenebis(4,6-di-t-butylphenyl) octyl phosphate, 2,2'-methylenebis (4,6-di-t-butylphenyl) octadecyl phosphite, 2,2'-methylenebis (4,6-di-t-butylphenyl) fluorophosphite, and tetrakis(2,4-di-t-butylphenyl)biphenylene diphosphonate.

It is desirable to incorporate such an organophosphorus antioxidant in an amount of from 0.001 to 2 parts by weight, preferably from 0.01 to 1.5 parts by weight, based on 100 parts by weight of the basic resin composition. Those organophosphorus antioxidants may be used alone or in combination of two or more thereof. Amounts thereof smaller than 0.001 part by weight are undesirable because the resin deteriorates considerably and hence yellows. Amounts thereof exceeding 2 parts by weight are undesirable because the antioxidant blooms considerably to impair the appearance of the wire-protective tube.

Known thioether antioxidants can be used in the basic resin composition according to need without particular limitations. Examples thereof include dialkyl thiodipropionates such as the dilauryl, dimyristyl, and distearyl esters of thiodipropionic acid and β-alkylmercaptopropionic acid esters of polyols, such as pentaerythritol tetra(β-dodecylmercaptopropionate).

It is desirable to incorporate such a thioether antioxidant in an amount of from 0.001 to 2 parts by weight, preferably from 0.01 to 1.5 parts by weight, based on 100 parts by weight of the basic resin composition. Those thioether antioxidants may be used alone or in combination of two or more thereof. Amounts thereof smaller than 0.001 part by weight are undesirable because the resin deteriorates considerably and hence yellows. Amounts thereof exceeding 2 parts by weight are undesirable because the antioxidant blooms considerably to impair the appearance of the wire-protective tube.

The phenolic antioxidants, organophosphorus antioxidants, and thioether antioxidants enumerated above may be used alone or in combination of two or more thereof, as long as the total amount thereof, in the case of using a combination of two or more thereof, is from 0.001 to 2 parts by weight, preferably from 0.01 to 1.5 parts by weight, based on 100 parts by weight of the basic resin composition.

Various additives can be suitably incorporated into the basic resin composition as long as the effects of the invention are not lessened thereby. Examples thereof include heat stabilizers such as hindered amine compounds; weathering agents such as hindered amine compounds; ultraviolet absorbers such as benzophenone compounds, benzotriazole compounds, and benzoate compounds; antistatic agents such as nonionic, cationic, and anionic compounds; dispersants such as bisamide compounds and waxes; lubricants such as amide compounds, waxes, organometallic salts, and esters; decomposers such as oxides; metal deactivators such as melamine compounds, hydrazine compounds, and amines; flame retardants such as phosphoric acid compounds, antimony trioxide, magnesium hydroxide, and red phosphorus; organic pigments; inorganic pigments; clarifiers or nucleators such as sorbitol compounds, metal salts of aromatic phosphoric acids, and metal compounds of organic acids; antifogging agents; antiblocking agents; blowing agents; organic fillers; and inorganic antibacterials and organic antibacterials, such as metal ions. However, the additives which can be optionally added should not be construed as being limited to these.

For blending the ingredients described above in the invention, methods in ordinary use for resin mixing can be employed without particular limitations. For example, a preferred method comprises mixing a polypropylene in a powder or pellet form with the propylene block copolymer described above, a bromine compound flame retardant, a flame retardant aid, and other resins, additives, fillers, etc. by means of a tumbler, Henschel mixer, Banbury mixer, ribbon feeder, supermixer, or the like, subsequently melt-kneading the mixture with a single- or multi-screw extruder (preferably a vented melt-kneading apparatus), a roll mill, or the like at a kneading temperature of from 150 to 300° C., preferably from 180 to 250° C., and then pelletizing the mixture. The sequence of adding those ingredients is not particularly limited, and the ingredients may be mixed in an order different from the above one. It is also possible to prepare a master batch containing optional additives and fillers in a high concentration and mix this master batch with the resins.

EXAMPLES

The invention will be explained below by reference to Examples and Comparative Examples for a clearer understanding of the invention. However, the invention should not be construed as being limited to these Examples.

(Preparation of Resin Compositions)

In Table 1 are shown the compositions and properties of the resins used in the Examples and Comparative Examples.

TABLE 1

| Kinds of Resins | | | | |
|---|---|---|---|---|
| | | Proportion of component eluted by temperature-rising elution fractionation method (wt %)/ethylene content (mol %) | | MFR |
| Symbol | Kind | Below 100° C. | 100° C. and higher | (g/10 min) |
| A | polypropylene | 5/0 | 95/0 | 8.5 |
| B | propylene/ethylene block copolymer | 16/7 | 84/0 | 10 |

TABLE 1-continued

| Kinds of Resins | | | | |
|---|---|---|---|---|
| | | Proportion of component eluted by temperature-rising elution fractionation method (wt %)/ethylene content (mol %) | | MFR |
| Symbol | Kind | Below 100° C. | 100° C. and higher | (g/10 min) |
| C | non rigid propylene block copolymer | 91/34 | 9/1 | 1.5 |
| D | non rigid propylene block copolymer | 86/24 | 14/1.5 | 1.5 |
| E | ethylene/propylene copolymer | 100/82 | 0/0 | 3.0 |

The flame retardants, flame retardant aid, and fillers used are as follows.

<Flame Retardants>

F: Tetrabromobisphenol A bis(2,3-dibromopropyl) ether
G: Tetrabromobisphenol S bis(2,3-dibromopropyl) ether
H: Tris(2,3-dibromopropyl) isocyanurate
I: Decabromodiphenyl ether <Flame Retardant Aid>

J: Antimony trioxide

<Ethylene/Vinyl Acetate Copolymer>

K: Ethylene/vinyl acetate copolymer

<Fillers>

L: Talc
M: Calcium carbonate

EXAMPLES AND COMPARATIVE EXAMPLES

The wire-protective tube samples used in the Examples and Comparative Examples were produced by the following steps.

(1) Premixing: According to each of the formulations shown in Table 2, a propylene block copolymer, flame retardant, flame retardant aid, ethylene/vinyl acetate copolymer, and filler were added to 100 parts by weight of a polypropylene. To each of these mixtures were added 0.2 parts by weight of tetrakis[methylene(3,5-di-t-butyl-4-hydroxyphenyl) propionate]methane as an antioxidant, 0.2 parts by weight of dilauryl thiopropionate as another antioxidant, and 0.2 parts by weight of aluminum stearate as a dispersant. The resultant mixtures each were premixed by means of a Henschel mixer. In the table, each ingredient amount is given in "parts by weight".

(2) Pelletization: The mixtures thus prepared each were melt-kneaded with a vented 50-mmϕ extruder and pelletized by strand cutting.

(3) Tube Molding: These pellets were subjected to extrusion molding with a 50-mmϕ extruder at a die temperature of 200° C. and a line speed of 35 m/min to obtain tubes having a wall thickness of 0.3 mm and an inner diameter of 10 mm.

TABLE 2

| No. | Polypropylene | Propylene block copolymer | Flame retardant | Amount of flame retardant (total) | Flame retardant aid J | Vinyl acetate resin K | Inorganic filler |
|---|---|---|---|---|---|---|---|
| 1 | A:100 | C:140 | F:8 + G:2 | 10 | 5 | — | — |
| 2 | A:100 | C:40 | F:6 | 6 | 3 | 42 | — |
| 3 | A:100 | C:320 | F:30 + G:10 | 40 | 25 | — | — |
| 4 | A:100 | D:200 | F:8 + H:4 | 12 | 6 | — | — |
| 5 | A:100 | D:400 | F:30 + H:10 | 40 | 25 | — | L:3 |
| 6 | A:100 | D:140 | F:10 + G:5 | 15 | 7 | 19 | L:23 |
| 7 | A:100 | C:100 | F:4 + G:1 | 5 | 3 | | — |
| 8 | A:100 | C:140 | F:8 + G:2 | 10 | 5 | — | M:4 |
| 9 | A:100 | C:100 | F:6 | 6 | 3 | 30 | L:2 |
| 10 | A:100 | C:140 | F:8 + G:2 | 10 | 5 | 12 | — |
| 11 | B:100 | C:140 | F:8 + G:2 | 10 | 5 | 12 | L:2 |
| 12* | A:100 | — | F:4 + G:1 | 5 | 3 | — | — |
| 13* | A:100 | — | F:8 + G:2 | 10 | 5 | 105 | — |
| 14* | A:100 | C:600 | F:60 + G:15 | 75 | 45 | | |
| 15* | A:100 | E:200 | F:10 + G:5 | 15 | 7 | — | — |
| 16* | — | C:100 | F:5 | 5 | 3 | — | — |
| 17* | B:100 | C:600 | G:40 | 40 | 20 | — | — |
| 18* | A:100 | D:400 | F:40 + G:20 | 60 | 35 | — | — |
| 19* | A:100 | D:600 | G:40 + H:20 | 60 | 35 | — | — |
| 20* | A:100 | D:140 | F:10 + H:5 | 15 | 5 | — | L:35 |
| 21* | A:100 | C:165 | I:100 | 100 | 35 | — | 100 |

Unit of each amount is parts by weight. Symbol * indicates Comparative Example.

Each of the tubes of the Examples and Comparative Examples was subjected to the following tests.

(a) Flame Retardancy: Oxygen index was determined in accordance with JIS K 7201, and flame retardancy was evaluated based on this index value.

(b) Flexural Modulus: Determined in accordance with JIS K 7203.

(c) Abrasion Resistance:

(1) Tape Abrasion Test

The test apparatus shown in FIG. 1 was used to conduct the test in the following manner. A sample 20 obtained by inserting into a tube 11 a metal rod 12 having a diameter almost equal to the inner diameter of the tube 11 is fixed, and is sandwiched between a pressing member 30 and an abrasion tape 21 supported by a roll 40. That side of the pressing member 30 which is in contact with the tube 11 has a fan-shaped section having a radius of curvature of 114 mm. The abrasion tape 21 comprises a No. 150 CC abrasion tape having strip-form conductive areas 32 arranged on the surface of the tape at a given interval (150 mm), each conductive area extending over the whole width of the tape. The tape 21 is stretched with the roll 40 so as to form angles of 30° with the sample 20. The metal rod 12 of the sample 20 has an electric wire 13 connected thereto. This electric wire 13 and the roll 40 each are connected to a conduction detector 50, so that when the tube 11 abrades and a conductive area 32 of the abrasion tape 21 comes into contact with the metal rod 12 to constitute a conducting state, then this state is detected by the conduction detector 50. In the test, a load F of 450 g (including the weight of metal rod) was applied to the pushing member 30, and the abrasion tape 21 was caused to run at a speed of 1,500 mm/min. The length of the abrasion tape 21 required before any of the conductive areas 32 of the abrasion tape 21 established a conducting state with the metal rod 12 was measured.

(2) Scrape Abrasion Test

Figure 2:
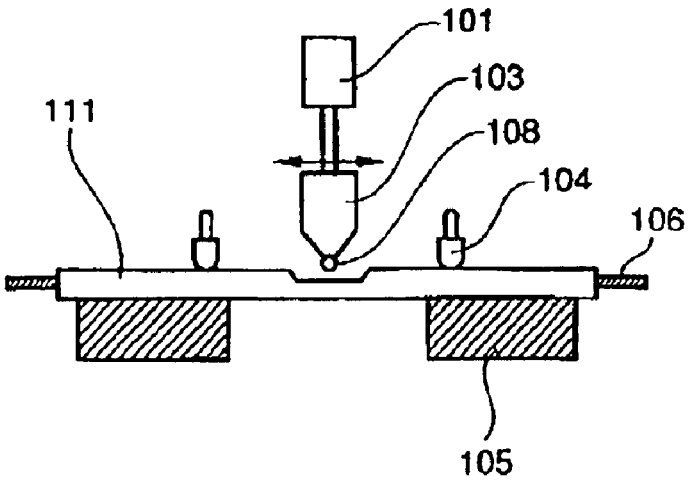
FIG. 2 is a diagrammatic view illustrating the test apparatus used in a scrape abrasion test.

The test apparatus shown in FIG. 2 was used to conduct the test in the following manner. A metal rod 106 having a diameter of 5 mm was inserted into a tube 111 having a length of about 40 mm, placed on a sample holder 105, and fixed with clamps 104. A plunger 103 having a piano wire 108 with a diameter of 0.45 mm fitted to the tip thereof was reciprocated (over a distance of 14 mm) on the tube 111 while pressing the plunger 103 against the tube 111 by applying a total load of 10 N thereto with the pressing member 101. The number of reciprocations required for the plunger 103 to penetrate the tube 111 and come into contact with the metal rod 106 was counted.

(d) Blooming Acceleration Test: A tube was allowed to stand in an 80° C. oven for 1 week and the surface of the tube was then examined. Nonblooming properties were evaluated in the following three ratings.

○: No blooming.

Δ: Slight blooming.

X: Blooming.

(e) Burn Mark Test: Each pelletized material (25 kg) was used to continuously mold a tube having an inner diameter of 10 mm with an extruder. The surface of the tube obtained was examined for burn marks and evaluated in the following three ratings.

○: No burn marks.

Δ: Slight burn marks.

X: Burn marks.

(f) Mold Fouling Test: Each pelletized material (25 kg) was used to continuously mold a tube having an inner diameter of 10 mm with an extruder. Thereafter, the surface of the sizing die was examined, and nonfouling properties were evaluated in the following three ratings.

○: No fouling.

Δ: Slight fouling.

X: Fouling.

(g) Productivity: Each pelletized material (25 kg) was used to continuously mold a tube having an inner diameter of 10 mm with an extruder. The appearance of the tube obtained was examined visually and by touching, and evaluated in the following three ratings. Furthermore, suitability for winding on a roll was visually evaluated.

○: Glossy.

Δ: Fishskined.

X: Difficult to wind.

(h) Oil Resistance: A tube was split open, and a test piece of the No. 3 dumbbell shape provided for in JIS C 6251 was punched out thereof. This test piece was immersed for 20 hours in a test oil [engine oil/kerosene=50/50 (by weight)] heated at 50° C. and was then examined for load at break and elongation at break.

(i) Heat Resistance (Resistance to Instantaneous Heating): A tube was held at 150° C. for 30 minutes, subsequently taken out, and then examined for the occurrence of fusion, cracking, or fracture.

○: No change.

Δ: Partial change in shape.

X: Fusion.

The results of each test are shown in Table 3. The table shows that the wire-protective tubes obtained in the Examples each gave satisfactory results in all the tests.

TABLE 3

| No. | Oxygen index (%) | Flexural modulus (MPa) | Tape abrasion (mm) | Scrape abrasion (number of reciprocations) | Blooming | Burn mark | Die fouling | Productivity | Oil resistance | Heat resistance 150° C. |
|---|---|---|---|---|---|---|---|---|---|---|
| 1 | 25.5 | 250 | 750 | 367 | ○ | ○ | ○ | ○ | ○ | ○ |
| 2 | 24.0 | 400 | 750 | 402 | ○ | ○ | ○ | ○ | ○ | ○ |
| 3 | 28.0 | 100 | 750 | 387 | ○ | ○ | ○ | ○ | ○ | ○ |
| 4 | 25.5 | 130 | 750 | 138 | ○ | ○ | ○ | ○ | ○ | ○ |
| 5 | 28.5 | 110 | 600 | 124 | ○ | ○ | ○ | ○ | ○ | ○ |
| 6 | 25.5 | 190 | 750 | 278 | ○ | ○ | ○ | ○ | ○ | ○ |
| 7 | 24.0 | 380 | 750 | 462 | ○ | ○ | ○ | ○ | ○ | ○ |
| 8 | 25.5 | 255 | 750 | 385 | ○ | ○ | ○ | ○ | ○ | ○ |
| 9 | 24.0 | 270 | 750 | 377 | ○ | ○ | ○ | ○ | ○ | ○ |
| 10 | 25.5 | 190 | 750 | 342 | ○ | ○ | ○ | ○ | ○ | ○ |
| 11 | 25.5 | 180 | 750 | 315 | ○ | ○ | ○ | ○ | ○ | ○ |
| 12* | 28.5 | 1700 | 1050 | unable to be measured | ○ | ○ | ○ | X | ○ | ○ |
| 13* | 21.5 | 380 | 900 | 187 | ○ | ○ | ○ | ○ | X | X |
| 14* | 28.5 | 80 | 600 | 115 | Δ | Δ | Δ | Δ | X | X |
| 15* | 21.0 | 300 | 750 | 422 | ○ | ○ | ○ | ○ | X | X |
| 16* | 24.0 | 50 | 600 | 102 | X | ○ | ○ | Δ | X | X |
| 17* | 23.5 | 75 | 600 | 118 | ○ | X | ○ | Δ | X | X |
| 18* | 28.5 | 110 | 750 | 273 | Δ | Δ | Δ | Δ | ○ | ○ |
| 19* | 26.0 | 80 | 600 | 126 | Δ | X | X | Δ | X | X |
| 20* | 20.5 | 450 | 900 | 411 | ○ | ○ | ○ | ○ | ○ | ○ |
| 21* | 21.0 | 300 | 750 | 366 | ○ | ○ | ○ | ○ | ○ | ○ |

As can be understood from the explanation given above, the wire-protective tube of the invention is equal or superior to PVC-based protective tubes in flexibility, oil resistance, abrasion resistance, and workability in wire insertion and, despite this, has flame retardancy, heat deformability, and heat shrinkability, because the tube is molded from a composition containing a resin ingredient obtained by mixing a polypropylene with a propylene block copolymer comprising propylene monomer units and ethylene monomer units in a specific proportion. The wire-protective tube is free from blooming and has an excellent appearance. With respect to weight reduction, it can exhibit an excellent performance higher than that of PVC-based tubes. In addition, the tube of the invention attains excellent productivity in tube production by extrusion molding.

What is claimed is:

1. A wire-protective tube which comprises a resin composition comprising:

polypropylene; and (a) from 10 to 500 parts by weight of a propylene block copolymer comprising a high-temperature component eluted at 100° C. or higher and a low-temperature component eluted at lower than 100° C. according to the temperature-rising elution fractionation method are from 1 to 40% by weight and from 99 to 60% by weight, respectively, wherein the high-temperature component is a polymer comprising from 100 to 90 mol % of a propylene monomer unit and from 0 to 10 mol % of an ethylene monomer unit, and wherein the low-temperature component is a polymer comprising from 90 to 50 mol % of a propylene monomer unit and from 10 to 50 mol % of an ethylene monomer unit;

(b) from 1 to 50 parts by weight of a bromine-based flame retardant; and (c) from 1 to 30 parts by weight of a flame retardant aid, each based on 100 parts by weight of the polypropylene.

2. The wire-protective tube according to claim 1, wherein the bromine-based flame retardant is at least one selected from the group consisting of tetrabromobisphenol A bis(2,3-dibromopropyl) ether, tetrabromobisphenol S bis(2,3-dibromopropyl) ether, and tris(2,3-dibromopropyl) isocyanurate.

3. The wire-protective tube according to claim 2, wherein the bromine-based flame retardant is a mixture of tetrabromobisphenol A bis(2,3-dibromopropyl) ether and tetrabromobisphenol S bis (2,3-dibromopropyl) ether or a mixture of tetrabromobisphenol A bis(2,3-dibromopropyl) ether and tris(2,3-dibromopropyl) isocyanurate.

4. The wire-protective tube according to claim 1, which further comprises from 0 to 50 parts by weight of an ethylene/vinyl acetate copolymer based on 100 parts by weight of the resin composition.

5. The wire-protective tube according to claim 1, which further comprises from 0 to 30 parts by weight of an inorganic filler based on 100 parts by weight of the resin composition.

* * * * *